US007770647B2

(12) United States Patent
Watson et al.

(10) Patent No.: US 7,770,647 B2
(45) Date of Patent: Aug. 10, 2010

(54) HYDRAULIC FRACTURING OF SUBTERRANEAN FORMATIONS

(75) Inventors: Marshall Charles Watson, Midland, TX (US); Donald W. Raymond, Pleasant Hill, CA (US)

(73) Assignee: ACT Operating Company, Midland, TX (US)

( * ) Notice: Subject to any disclaimer, the term of this patent is extended or adjusted under 35 U.S.C. 154(b) by 8 days.

(21) Appl. No.: 12/260,786

(22) Filed: Oct. 29, 2008

(65) Prior Publication Data

US 2010/0101795 A1 Apr. 29, 2010

(51) Int. Cl.
*E21B 43/267* (2006.01)
*E21B 43/27* (2006.01)

(52) U.S. Cl. ..... 166/308.3; 166/280.1; 166/307

(58) Field of Classification Search ..... None
See application file for complete search history.

(56) References Cited

U.S. PATENT DOCUMENTS 3,768,564 A 10/1973 Knox et al.
4,044,833 A 8/1977 Volz
4,566,539 A 1/1986 Perlman
4,665,990 A 5/1987 Perlman
5,310,003 A 5/1994 Jennings
2007/0240880 A1* 10/2007 Olsen ..... 166/259

OTHER PUBLICATIONS

Economides, M.J., et al., Reservoir Stimulation, 3rd ed., Chichester, England; New York: J. Wiley. 1 v., 88 pages Part 1 of 2.
Economides, M.J., et al., Reservoir Stimulation, 3rd ed., Chichester, England; New York: J. Wiley. 1 v., 104 pages Part 2 of 2.
Olsen, T.N., et al., "Improvement Process for Coalbed Methane Natural Gas Completion and Stimulation," Presented at the SPE ATC, Denver, CO, Oct. 5-8, 2003, 16 pages.
Diamond, W.P., et al., "Effects of Stimulation Treatments on Coalbeds and Surrounding Strata: Evidence From Underground Observations," Pittsburgh, PA: U.S. Dept. of the Interior, Bureau of Mines, ii, 1987, 53 pages.
Wang, S.G., et al., "Case Studies of Propped Refracture Reorientation in the Daqing Oil Field," Presented at the SPE Hydraulic Fracturing Technology Conference, College Station, TX, 2007, 7 pages.

(Continued)

*Primary Examiner*—Zakiya W. Bates
(74) *Attorney, Agent, or Firm*—Edmonds & Nolte, PC

(57) ABSTRACT

Methods of hydraulically fracturing subterranean coal seams and formations resulting in improved permeability to stimulate Coalbed Methane. In one method, the coal seam is fractured using a proppant-containing fracturing fluid in alternating stages with an aqueous base solution that etches the fracture faces of the coal thereby creating channels for fluid flow. In another method, the coal seam is fractured using a fracturing fluid without propping agents in alternating stages with an aqueous base solution that is pumped at a pressure sufficient to maintain the fractures in an open position thereby etching the fracture faces to create channels for fluid flow. In yet another embodiment, a base solution is injected into the formation at a pressure sufficient to create fractures therein and simultaneously etch the faces of the open fractures to thereby form channels in the faces for increased fluid flow.

35 Claims, 3 Drawing Sheets

OTHER PUBLICATIONS

Myers, R.R., et al., "Field Application of an Alternative Foaming Agent for Coalbed Methane in the Nora Field in Southwestern Virginia," Presented at the Eastern Regional Meeting, Charleston, WV, Oct. 20-22, 1999, 15 pages.

Hollub, V.A., et al., "A Guide to Coalbed Methane Operations," Chicago, IL: Gas Research Institute, 1992, 18 pages.

Penny, G., et al., "Microemulsion Additives Enhance Fluid Recover, Provide H2S Mitigation, and Prevent Formation Damage for Stimulation, Drilling and Remediation Operations," Presented at the Southwest Petroleum Short Course, Lubbock, TX, Apr. 20-21, 2005, 9 pages.

Nguyen, P.D., et al., "Controlling Formation Fines at Their Sources to Maintain Well Productivity," SPE Production & Operations. 22(2): p. 202-215, May 2007, 19 pages.

Zahid, S., et al., "Development of Unconventional Gas Resources: Stimulation Perspective," Presented at the Production and Operatyions Symposium, Oklahoma City, OK, Mar. 31-Apr. 3, 2007, 11 pages.

Palmer, I.D., "Induced Stresses Due to Propped Hydraulic Fracture in Coalbed Methane Wells," Presented at the Low Permeability Reservoirs Symposium, Denver, CO, Apr. 26-28, 1993, 12 pages.

Rodvelt, G., et al., "Multiseam Coal Stimulation Using Coiled-Tubing Fracturing and a Unique Bottomhole Packer Assembly," Presented at the SPE Eastern Regional meeting, Canton, OH, Oct. 17-19, 2001, 11 pages.

Byrne, W.E., et al., "Composite Bridge Plug Technology for Coalbed Ethane Increases Efficiency and Reduces Costs of Completing CBM Wells," Presented at the International Coalbed Methane Symposium, Tuscaloosa, AL, May 22-24, 2007, 9 pages.

Palmer, I., et al., "CBM Well Completions and Production: Field Data, Best Practices, New Technology," Presented at the 2007 International Coalbed Methane Symposium Short Course Tuscaloosa, AL May 22, 2007, 96 pages Part 1 of 2.

Palmer, I., et al., "CBM Well Completions and Production: Field Data, Best Practices, New Technology," Presented at the 2007 International Coalbed Methane Symposium Short Course Tuscaloosa, AL May 22, 2007, 85 pages Part 2 of 2.

* cited by examiner

HYDRAULIC FRACTURING OF SUBTERRANEAN FORMATIONS

BACKGROUND OF THE INVENTION

Coalbed Methane (CBM) is a natural gas formed by geological processes in coal seams and consists predominantly of methane, the major chemical component in natural gas. CBM is an all in one natural gas resource as it serves as the source, reservoir and trap for a vast amount of potential natural gas. Typically, CBM can be found unexploited at very shallow depths, and because methane is stored in coal by a different means than conventional gas, more gas per unit volume can be recovered at these shallow depths.

Various methods have been utilized by the energy industry to extract CBM from a subterranean formation. In most instances well bores are drilled to penetrate the hydrocarbon-containing portions of the subterranean formation into sections of the subterranean formation commonly referred to as "production intervals." A subterranean formation penetrated by a well bore may have multiple production intervals at various depths in the well bore.

Generally, after a well bore has been drilled to a desired depth, completion operations may be performed, usually involving the insertion and cementing of steel casing into the well bore. To be able to produce hydrocarbons from the coal seam, one or more perforations are normally created to penetrate through the casing and cement, and into the production interval. Generally, the produced hydrocarbons flow from the production intervals, through the perforations that connect the production intervals with the well bore, into the well bore, and ultimately to the surface. At some point during completion operations, the production interval may be "stimulated" to enhance hydrocarbon production.

Numerous methods have been developed and used successfully for stimulating the production of CBM from coal seams. Typical stimulation operations may involve hydraulic fracturing, acidizing, or fracture acidizing.

Hydraulic fracturing stimulation typically includes injecting or pumping a viscous fracturing fluid into a portion of the subterranean formation at a rate and pressure such that fractures are formed or enhanced into the portion of the subterranean formation. The incident pressure causes the formation to crack which allows the fracturing fluid to enter and extend the crack further into the formation. The fractures tend to propagate as vertical and/or horizontal cracks located radially outward from the well bore.

In such treatments, once the hydraulic pressure is released, the fractures formed will tend to close back onto themselves, possibly cutting off any hydrocarbon flow. To prevent this closure, oftentimes a particulate material, known as "proppant," is placed in the fractures by suspending them in the injected fracturing fluid during at least a portion of the fracturing operation. The proppant is carried into the newly created fractures and deposited therein such that when the hydraulic pressure is released the proppant acts to prevent the fracture from fully closing, and thus, aids in forming conductive channels through which fluids may flow into the well bore. The proppant, commonly a sieved round sand, is used since it is higher in permeability than the surrounding formation. The propped hydraulic fracture, therefore, becomes a highly permeable conduit through which the formation fluids can be produced back to the well.

In some applications, hydraulic fracturing stages are immediately followed by the injection of an acidizing solution. The acid serves several functions including flowing above the fracture fluid and proppant deposited in the lower portion of a vertical fracture thus having a tendency to widen and vertically extend the upper portion of a fracture. Acidizing may also initiate new fractures and clean the well bore and fracture faces by dissolving any precipitates or contaminants due to drilling or completion fluids or cement which may be present at or adjacent the well bore or fracture faces.

Although there are several fracturing and stimulation methods already in use, it remains desirable to find improved methods for fracturing subterranean coal seams. In particular, it is desirable to find methods that may introduce different fracturing fluids having diverse chemical properties and methods that reduce or eliminate the need for proppants. By doing so, significant time and expense savings may be accrued by not having to provide a typical fracture fluid and propping agent.

SUMMARY OF THE DISCLOSURE

The present disclosure is directed to a method for generating fractures within a subsurface coal seam resulting in improved conductivity and more uniform width to stimulate Coalbed Methane (CBM). In particular, the present disclosure relates to methods of hydraulically fracturing subsurface coal seams, and further forming channels of high-fluid conductivity thereon by means of chemical etching involving aqueous oxidizing agents. As such, the present disclosure may reduce, or eliminate completely, the need for proppants and proppant carriers, like gels or foams. In alternative embodiments, however, suitable propping agents may optionally be added for further increasing the CBM productivity.

In one exemplary embodiment of the present disclosure, a method of fracturing a subsurface coal formation is herein disclosed. The method may include pumping a fracturing fluid containing proppants into the subsurface coal formation in a multiplicity of stages and at a pressure sufficient to initiate the propagation of fractures within the coal formation, then allowing the fractures to close and trap the proppant thereby preventing the fractures from fully closing, and further injecting an oxidizing agent solution into the subsurface coal formation following each stage of fracturing fluid pumping, whereby the oxidizing agent solution may etch channels into fracture faces.

In another exemplary embodiment of the present disclosure, another method of fracturing a subsurface coal formation is also disclosed. The method may include pumping a proppant-free fracturing fluid into a subsurface coal formation to induce fractures therein and expose fracture faces, then injecting an oxidizing agent solution into the coal formation while maintaining the fractures in an open position to etch channels into the fracture faces, and then allowing the fractures to close so that channels remain for CBM fluid flow.

In yet another exemplary embodiment of the present disclosure, another method of fracturing a subsurface coal formation is disclosed. The method may include injecting an oxidizing agent solution into a subsurface coal formation to cause sufficient pressure on the coal formation to create and open fractures thereby exposing fracture faces, then allowing the base solution to etch the fracture faces to form channels thereon, and then reducing the pressure on the coal formation so that the fractures close but the channels remain.

In yet another exemplary embodiment of the present disclosure, another method of fracturing a subsurface coal formation is disclosed. The disclosed method may comprise injecting an oxidizing agent containing propping agents into a subsurface coal formation at a rate and pressure sufficient to cause the formation of at least one fracture, thereby exposing at least one fracture face; allowing the oxidizing agent solution to etch the at least one fracture face, thereby forming channels thereon; and reducing the pressure subsurface coal formation and allowing the at least one fracture to close thereby trapping the propping agents in the at least one fracture to prevent the at least one fracture from fully closing.

In yet another exemplary embodiment of the present disclosure, a method of stimulating a subsurface coal seam penetrated by a well bore having a well bore intake, wherein the subsurface coal seam was previously stimulated, is disclosed. The method may comprise injecting an oxidizing agent solution into the well bore and subsurface coal seam at a pressure below the fracture gradient of the subsurface coal seam, wherein the subsurface coal seam has at least one existing fracture; and allowing the oxidizing agent solution to channel through the at least one existing fracture, to clean the well and the at least one existing fracture, to transport coal fines away from the well bore intake, or to etch at least one fluid flow channel on the at least one existing fracture or enhance any existing fluid flow channels on the at least one existing fracture.

In yet another exemplary embodiment of the present disclosure, a method of stimulating a subsurface coal seam penetrated by a well bore having a well bore intake, wherein the subsurface coal seam was previously stimulated, is disclosed herein. The method may comprise injecting an oxidizing agent solution into the well bore and subsurface coal seam to cause a pressure on the subsurface coal seam sufficient to create and open at least one fracture; allowing the oxidizing agent solution to channel through the at least one fracture, to clean the well and the at least one fracture, to transport coal fines away from the well bore intake, or to etch at least one fluid flow channel on the at least one fracture or enhance any existing fluid flow channels on the at least one fracture; and reducing the pressure on the subsurface coal seam so that the at least one fracture closes but the fluid flow channels remain for fluid flow.

DETAILED DESCRIPTION

Figure 1:
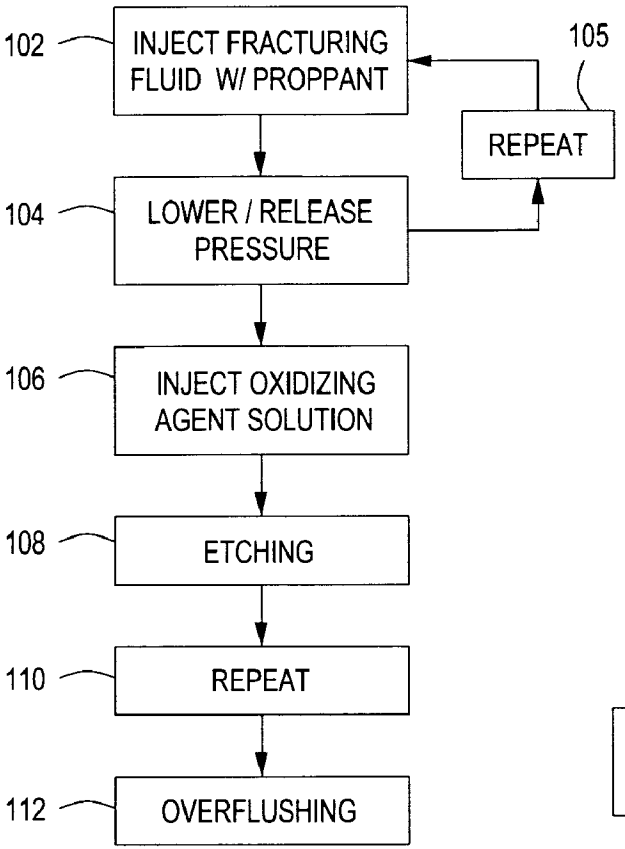
FIG. 1 is a schematic flowchart of a method according to one or more aspects of the present disclosure.

In an exemplary embodiment of the present disclosure, the method comprises injecting, or pumping stagewise a proppant-containing fracturing fluid alternated with an oxidizing agent solution into a subsurface coal seam formation adjacent to a well bore. The oxidizing agent solution is injected to react with, etch, and roughen the coal fracture faces thereby providing good conductivity and permeability for fluid flow when the operation is complete. The exemplary embodiments of the methods described herein may be carried out by any conventional apparatus used for previously known methods of hydraulic fracturing. Furthermore, if desired, conventional proppant-water mixing equipment and pumping equipment may be utilized in performing the method.

Moreover, particulate materials may be employed as propping agents in various embodiments of the disclosure. In an exemplary embodiment, spherical sand is used as the propping agent, having a particle size distribution between about 60 and about 140 mesh, generally averaging about 100 mesh. In alternative embodiments, various other types of proppant may be used, including resin-coated sand, and man-made ceramics; depending on the type of permeability or grain strength needed in the particular application.

Although it is possible to use water or other fluids from any suitable source, the fracturing fluid used in carrying out various embodiments of the present disclosure may be water produced from the coal seam or an adjacent formation. Furthermore, although carriers such as gels, cellulose derivatives, or synthetic polymers are often added to typical fracturing fluids to obtain a sufficient viscosity to suspend the proppants, preferably, no carriers are mixed with the fracturing fluids of the present embodiments since they tend to damage coal. However, if desired in alternative embodiments, carriers may be used as required by the particular application without departing from the spirit and scope of the present disclosure.

In one embodiment, the fracturing fluid and alternating oxidizing agent solution may be injected through the well tubing, casing, or other available or suitable pipe or conduit. The fracturing fluid may be injected through perforations in the casing that extend through the cement and into the formation; the injection being confined to the selected coal seam through isolation techniques. Typically, the well may be completed by traditional open-hole techniques to avoid the problem of sand-out, commonly found in operations using sand-proppant contained in fracturing fluid that flows through casing perforations.

In the initial pumping stage of the fracturing fluid, although it is not necessary, proppant may be added. The amount of proppant that can be carried in the fracture fluid varies with the type of fluid used, but commonly about 0.2 to about 3 pounds of sand per gallon of fracture fluid is used. The proppant serves several functions. Its spherical shape substantially reduces abrasion to the face of the fracture, thereby largely eliminating the problems associated with particles of coal becoming mixed with the proppant. Also, spherical proppants having a small particle size exhibit less tendency to become embedded in the face of the fracture and inhibit creep of the coal into the propped fracture. Lastly, when the pressure on the fracturing fluid is reduced and the formation face is allowed to compress the proppants, the proppant particles resting in the fractures provide a formation consolidating effect. In short, the permeability of fine proppants is much greater than that of the coal seam. Thus, if the fracture is wide enough, the fluidic conductivity of the propped fracture is sufficient to improve production and overall recovery of CBM from the coal seam.

In exemplary operation, the proppant-containing fracturing fluid may be injected into the coal seam in a multiplicity of stages. The rate of injection may range from about 10 to about 60 barrels per minute to initiate as much branch fracturing as possible. Succeeding stages of hydraulic fluid injection may incrementally increase the amount of proppant mixed. Each incremental increase may be from about 0.2 to about 1 lb. of proppant per gallon of fracture fluid. Depending on the application, these fracturing steps may be repeated until a satisfactory amount of fractures have been propagated and held open with proppant.

Following each proppant-containing fracture fluid injection stage, an oxidizing agent solution may then be injected into the formation at about the same rate as the fracturing fluid injection stages. In an exemplary embodiment of operation, the multiplicity of stages of the method may include alternatingly pumping 100 barrels of oxidizing agent solution with 100 barrels of proppant-containing fracturing fluid. The total volume of oxidizing agent solution injected into the coal seam depends on the size of the fracture and the pressure and flow resistance.

In operation, the oxidizing agent solution reacts with coal in a dissolving, or etching process involving the scission of carbon-carbon and carbon-hydrogen bonds, resulting in the formation of carbon-oxygen bonds. During this process, these bonds are broken and volatiles such as carbon dioxide, methane and water, are released along with other volatile functional groups. The result is overall mass weight loss of the coal substance accounted for by the creation, or etching, of defined channels in the surface of the coal that may be capable of fluid flow. In exemplary operation, when the fluid pressure in the coal seam is ultimately released and the fractures close, the unevenly etched surfaces of the coal retain these etched channels, resulting in an increased overall permeability of the coal seam.

In an exemplary embodiment, the oxidizing agent may include an aqueous chemical base, such as sodium hypochlorite (NaClO), commonly known as bleach. One advantage to using sodium hypochlorite is that it is a relatively inexpensive oxidizing agent as compared to other bases, such as hydrogen peroxide. Sodium hypochlorite, with a pH level of approximately 11.0, acts as a strong oxidizing agent when in contact with coal. This oxidization process artificially increases the rank of coal, resulting in a proportional increase in the coal's permeability. In alternative embodiments, this increase in coal permeability may serve to either reduce, or totally eliminate, the need for propping agents.

Suitable etching results may be obtained with an aqueous oxidizing agent containing about 0.4M sodium hypochlorite solution. In alternative exemplary embodiments, other oxidizing agents may be used, preferably chemical bases having a pH level of between about 9.0 and about 13.0. In alternative embodiments, the oxidizing agent solution may also contain one or more additives such as surfactants, suspending agents, sequestering agents, anti-sludge agents, and/or corrosion inhibitors as the application requires. Moreover, if desired for a particular application, the oxidizing agent solution may also contain a proppant, preferably about 1 pound of proppant per gallon of solution.

Referring to FIG. 1, an exemplary method of fracturing a formation as described above is illustrated. The method may include injecting a fracturing fluid 102 into a subsurface coal seam at a pressure sufficient to initiate the propagation of at least one fracture within the coal formation, thereby exposing fracture faces in the coal formation. In one embodiment, the fracturing fluid may contain proppants configured to prevent to the fracture(s) from fully closing. The fracturing fluid pressure may then be released at step 104, allowing the fracture(s) to close and thereby trapping the proppants in the fracture(s). Optionally, the preceding steps 102, 104 may then be repeated until a satisfactory amount of fractures have been propagated and held open with proppant, as shown at step 105. An oxidizing agent solution may then be injected into the coal seam at step 106. Injecting an oxidizing agent may serve to etch the now-exposed fracture faces, as shown in step 108. The preceding steps may then be repeated 110 until the fractures are propagated sufficiently or the fracture faces have been adequately etched for increased CBM fluid flow.

In some applications, the foregoing method may result in the accumulation of coal fines generated by either the mechanical shearing action or the chemical oxidation of the coal. An excess of fines in a coal seam, especially near the well bore intake, may impede the extraction of CBM from the coal seam. To move the generated coal fines away from the well bore intake, the method described above may further include overflushing the well bore, as shown in step 112, which may include pumping into the well bore a volume of about 100 to about 300 barrels of fluid above the well bore capacity. In an exemplary embodiment, overflushing may be completed using fresh water, formation water, or salt water as is known in the art. In operation, overflushing may serve to transport a substantial portion of the fines deep into the coal seam and/or fracture system and away from the well bore.

In alternative exemplary embodiments, prior to any exemplary fracturing or etching processes as described above or below, an existing well bore may be treated with an acidizing process which may serve as a cleansing agent. In particular, an acid may be pumped into an existing well bore to clean the well bore and existing fracture faces by dissolving any precipitates or contaminants due to drilling or completion fluids or cement that may be present at or adjacent the well bore and fracture faces. In one embodiment, an appropriate acid may include an aqueous solution of about 15% by weight hydrochloric acid (HCl). As can be appreciated, however, alternative embodiments may employ acid solutions encompassing comparable pH levels and concentrations without departing from the scope of the present disclosure.

In another exemplary embodiment of the present disclosure, propping agents are not used in the fracturing and/or stimulating of a coal seam. Instead, the coal seam is hydraulically fractured using proppant-free fluids and techniques, and stimulated by alternatingly injecting an oxidizing agent solution to increase the coal seam permeability. The oxidizing agent solution that may be used in the exemplary embodiment may include the aqueous chemical bases and their equivalents, as described above.

In particular, a proppant-free fracturing fluid is pumped into the formation through the well bore at a sufficient rate and pressure causing the formation to fracture. The fractures formed are extended as much as possible by continued pumping of the fracturing fluid into the formation. After the formation has been fractured and the fractures extended, a quantity of oxidizing agent solution may then be pumped into the formation at a pressure equal to or greater than the pressure at which fracturing of the formation occurred. The high pressure maintained on the formation during the injection of the oxidizing agent solution causes the fractures to be held open, i.e., the fracture faces are held apart as the oxidizing agent solution is pumped through the fractures.

In exemplary operation, the oxidizing agent may attack the faces of the coal fractures causing fluid-flow channels to be etched therein. The pumping may then be stopped and the pressure on the formation lowered below the pressure at which the formation was initially fractured. The lowering of the pressure on the formation causes the fracture(s) to close, leaving several channels on the faces of the fracture(s) that are capable of fluid flow therein. The resulting fluid-flow channels may reduce, or eliminate completely, the need for any propping agents, since the necessary permeability of the coal seam may be achieved through etching of the coal surfaces.

If desired, additional oxidizing agent solution may then be pumped into the formation through the well bore at a pressure below the fracture pressure gradient at which the initial fracturing of the formation occurred, but sufficient to cause the oxidizing agent to flow through the channels formed in the faces of the fracture(s). As the additional oxidizing agent solution flows through the previously formed channels, the channels may be etched and enlarged even further. In exemplary operation, the additional oxidizing agent solution pumped through the closed fractures does not necessarily contact portions of the fracture faces. As a result, the non-contacted portions may provide formation support by preventing the fracture faces from crushing together and destroying the flow channels. As such, propping agents would not be necessary as the desired permeability of the coal seam is achieved solely through the etching of the exposed coal surface.

Figure 2:
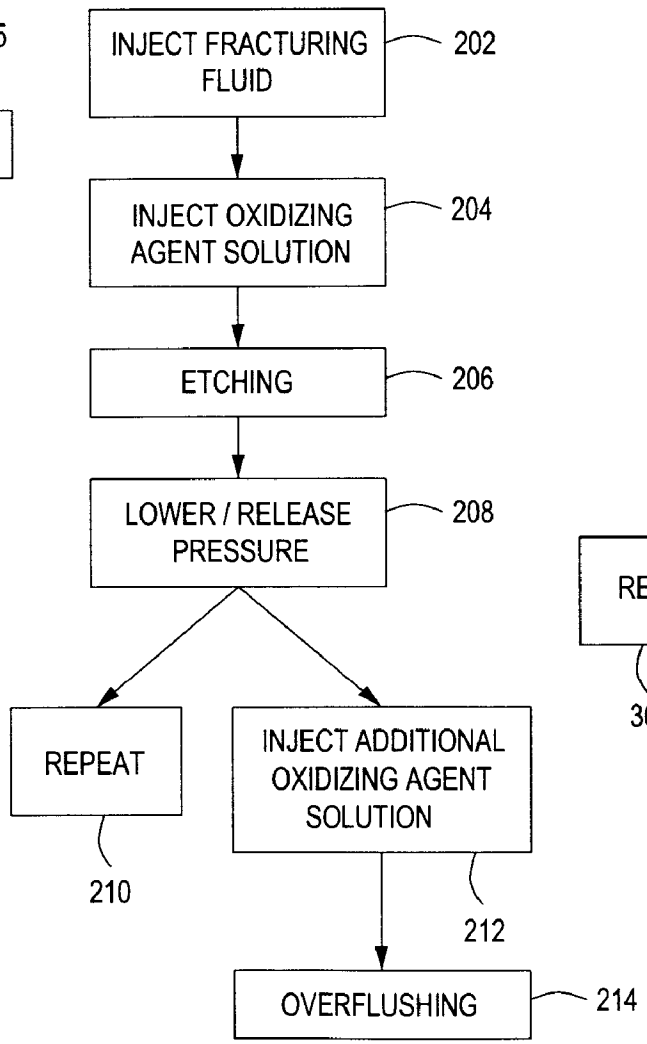
FIG. 2 is a schematic flowchart of a method according to one or more aspects of the present disclosure.

Referring to FIG. 2, the above-described exemplary method of fracturing a coal seam formation is illustrated. The method may include injecting a fracturing fluid into a subsurface coal seam at a pressure sufficient to initiate the propagation of at least one fracture within the coal seam formation and thereby expose at least one fracture face, as shown at step 202. The fracturing fluid may be proppant-free. An oxidizing agent solution may then be injected into the coal seam at a pressure equal to or greater than the pressure at which fracturing of the formation occurred, as shown at step 204. Besides possibly creating more fractures, the oxidizing agent solution may etch the now-exposed at least one fracture face thereby creating channels for fluid flow, as shown in step 206. The pressure in the coal formation may be lowered 208 allowing the at least one fracture to close. Optionally, these steps may be repeated 210 until sufficient fractures and/or fluid-flow channels have been created in the coal seam. Alternatively, additional oxidizing agent solution may be injected at a pressure below the pressure at which the fracturing of the formation occurred, but sufficient to cause the oxidizing agent to flow through the channels formed in the at least one fracture face, as shown as step 212. This additional oxidizing agent may enlarge the channels, resulting in greater permeability of the coal seam for increased CBM fluid flow. If desired, as shown in step 214, the well bore and coal seam may then be overflushed, as described in previous embodiments, to move any generated coal fines away from the well bore intake, thus increasing CBM recovery efficiency.

In another exemplary embodiment of the present disclosure, an oxidizing agent solution may be used to fracture a subsurface formation as well as to create fluid flow channels in the fracture faces for increased permeability. As can be appreciated, significant time and expense savings are accrued by not having to provide the typical fracture fluid and an appropriate propping agent.

The exemplary method may include injecting only an oxidizing agent solution into a coal seam formation, resulting not only in the hydraulic fracturing of the coal seam, but also in the etching of the newly exposed coal fracture, thereby providing amplified conductivity and permeability. Similar to the previously disclosed embodiments, because the oxidizing agent chemically reacts with the coal and creates fluid-flow channels thereon, the need for proppant may be reduced or even eliminated. The oxidizing agent solution that may be used in the exemplary embodiment may include aqueous chemical bases and their equivalents, as described above.

In an exemplary embodiment of operation, the oxidizing agent solution may be pumped into the formation through the well bore at a rate and pressure sufficient to cause the coal formation to fracture. The pumping may be continued at or above the fracture pressure gradient so that the resulting fractures may be held open, extended outwardly from the well bore, and channels etched in the now-exposed fracture faces. Once the fractures have been extended and etched by the oxidizing agent solution, the pressure exerted on the formation may be lowered so that the fractures close, leaving several etched channels capable of fluid flow. If desired, additional oxidizing agent solution may then be pumped through the closed fractures in the same manner as described above to cause the newly-formed channels to be etched and enlarged further.

Figure 3:
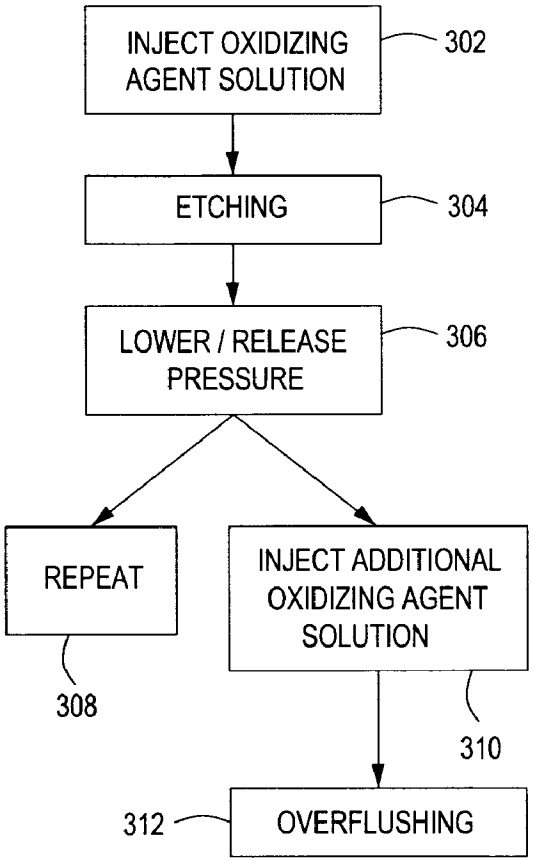
FIG. 3 is a schematic flowchart of a method according to one or more aspects of the present disclosure.

Referring to FIG. 3, the above-described exemplary method of fracturing a formation is illustrated. The method may include injecting an oxidizing agent solution into a subsurface coal seam at a pressure sufficient to initiate the propagation of at least one fracture within the coal formation and thereby expose at least one fracture face, as shown at step 302. The injection of the oxidizing agent solution is continued at or above the fracturing pressure so that the at least one fracture is held open, extended outwardly from the well bore, and channels are etched in at least one now-exposed fracture face, as shown at step 304. Once the fractures have been extended and etched by the oxidizing agent to form channels therein, the hydraulic pressure exerted on the formation may then be released, as shown at step 306, resulting in the closure of the at least one fracture, yet leaving several channels capable of fluid flow. These steps may be either repeated 308 or additional oxidizing agent solution may be injected 310 at a pressure below the pressure at which the fracturing of the formation occurred, but sufficient to cause the oxidizing agent solution to flow through the channels formed in the at least one fracture face. This additional oxidizing agent solution may serve to enlarge the channels, resulting in greater permeability of the coal seam for increased CBM fluid flow. If desired, as shown in step 312, the well bore and coal seam may then be overflushed, as described in the exemplary embodiments above, to move any generated coal fines away from the well bore intake, thus increasing CBM recovery efficiency.

In another exemplary embodiment of the present disclosure, an oxidizing agent solution containing proppants may be used to hydraulically fracture a subsurface coal seam as well as to etch fluid flow channels in the fracture faces for increased permeability. The oxidizing agent solution that may be used in the exemplary embodiment may include aqueous chemical bases and their equivalents as described above. Spherical sand, as described above, may be used as the propping agent.

In an exemplary embodiment of operation, the proppant-containing oxidizing agent solution may be pumped into the coal formation through the well bore at a rate and pressure sufficient to cause the formation to fracture. The pumping may be continued at or above the fracturing pressure so that any resulting fractures are held open and extended outwardly from the well bore. As the proppant-containing oxidizing agent extends deeper into the fractures, the proppant may be deposited therein while the oxidizing agent acts to etch the newly-formed faces of the fractures and form fluid-flow channels thereon.

The injection pressure may then be reduced to allow the fractures to compress the proppants which serve to hold the fracture faces slightly open. Furthermore, as the fracture faces compress the proppants, the fluid-flow channels remain therein as a result of the etching process. The combination of etched fluid-flow channels and proppant deposits in the fractures may increase the permeability of the coal seam and improve production and overall recovery of CBM from the coal seam. If desired, additional proppant-free oxidizing agent solution may then be pumped through the closed fractures below the fracture pressure gradient in the same manner as described above to cause the fluid-flow channels to be etched or enlarged even further.

In an exemplary embodiment, the proppant-containing oxidizing agent may be injected into the coal seam in a multiplicity of stages. The rate of injection may range from about 10 to about 60 barrels per minute in an attempt to initiate as much branch fracturing as possible. Succeeding stages of injection may incrementally increase the amount of proppant mixed. For example, each incremental increase may be from about 0.2 to about 1 lb. of proppant per gallon of oxidizing agent.

Figure 4:
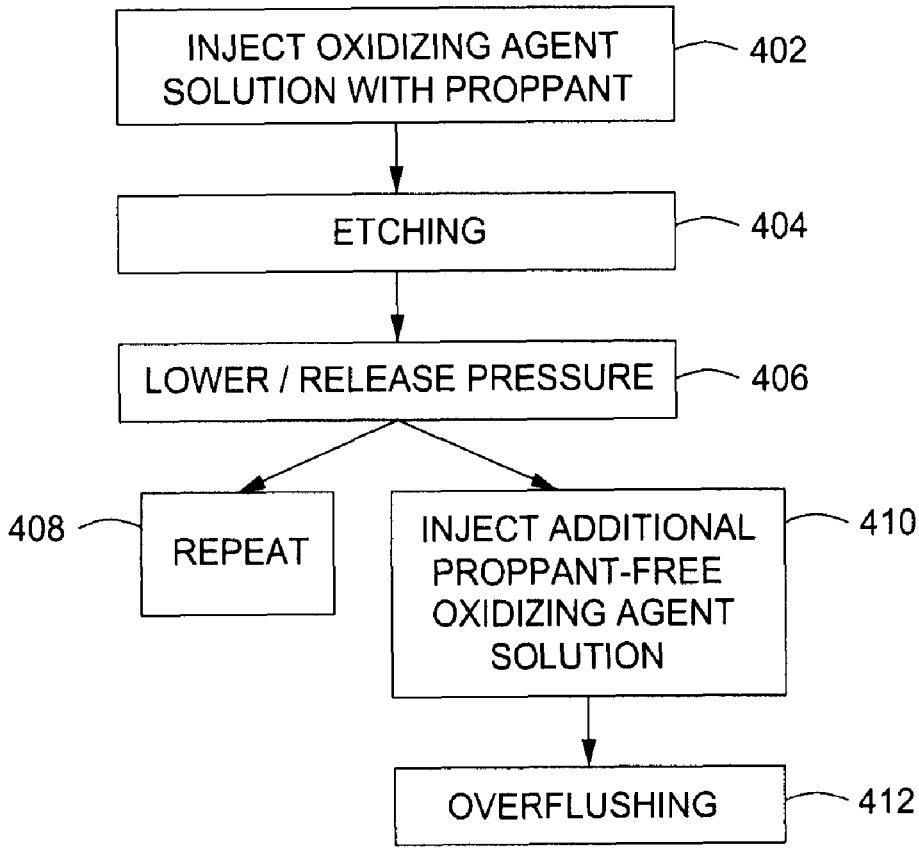
FIG. 4 is a schematic flowchart of a method according to one or more aspects of the present disclosure.

Referring to FIG. 4, the above-discussed exemplary method of fracturing a formation is illustrated. A proppant-containing oxidizing agent solution may be injected into a coal seam formation at a rate and pressure sufficient to cause the coal formation to fracture, as shown at step 402. The rate of injection may continue at or above the fracturing pressure so that the fractures formed are held open, extended outwardly from the well bore, and channels are etched in the fracture faces by the oxidizing agent solution, as shown at step 404. As the oxidizing agent extends deeper into the fractures, proppant may be deposited therein while the oxidizing agent acts to etch the faces of the fractures and form fluid-flow channels therein.

The injection pressure may then be lowered or released to allow the fractures to compress the proppants which serve to hold the fracture faces slightly open, as shown in step 406. Furthermore, as the fracture faces compress on the proppants, the fluid-flow channels remain therein as a result of the etching process, thus increasing the permeability of the coal seam for enhanced CBM extraction. These steps may then be repeated 408, or, if desired, additional proppant-free oxidizing agent solution may be injected into the closed fractures to re-etch and enlarge the fluid-flow channels for increased permeability, as shown in step 410. If desired, as shown in step 412, the well bore and coal seam may then be overflushed, as described in the embodiments above, to transport any generated coal fines away from the well bore intake, thus increasing CBM recovery efficiency.

In another exemplary embodiment of the present disclosure, an oxidizing agent solution may be applied to a well bore and coal seam that has previously been treated and/or stimulated using prior methods, but may produce additional CBM if now stimulated by an oxidizing agent. An exemplary oxidizing agent solution may include the exemplary aqueous chemical bases and their equivalents, as described above.

In exemplary operation, the oxidizing agent solution may be pumped into an existing well bore and into an adjacent coal seam at a pressure below the fracture pressure gradient of the coal seam. As the oxidizing agent solution passes, or channels through the existing coal seam fractures created by a previous stimulation operation, it may serve several functions: It may serve as a cleansing agent by dissolving any precipitates or contaminants that may be present at or adjacent to the well bore or fracture faces due to drilling or completion fluids or cement; it may dissolve any existing coal fines or transport them away from the well bore intake and into the coal seam fractures; and it may further etch or enhance any existing fluid flow channels in the fracture faces for improved coal seam permeability.

Figure 5:
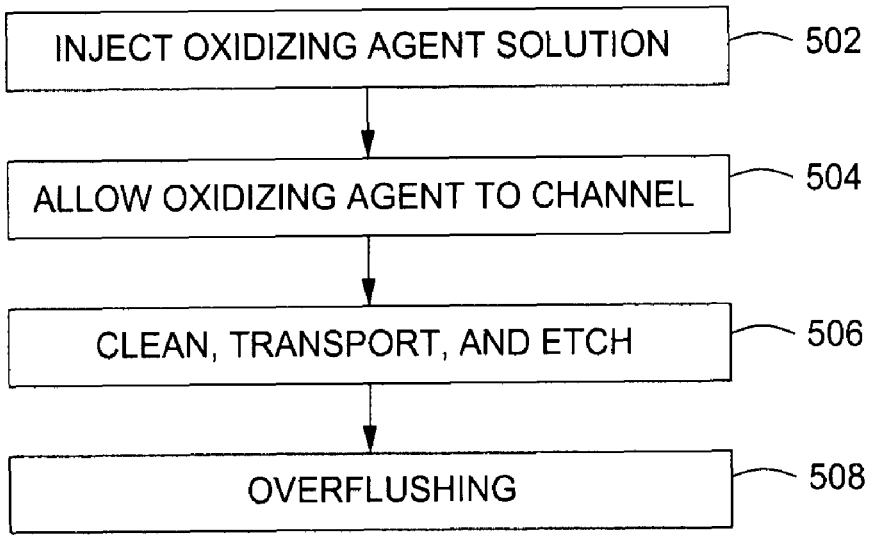
FIG. 5 is a schematic flowchart of a method according to one or more aspects of the present disclosure.

Referring to FIG. 5, illustrated is the above-mentioned method of stimulating a previously-stimulated coal seam. At a pressure below the fracture gradient of a coal seam, an oxidizing agent solution may be injected into an existing well bore and adjacent coal seam that were previously stimulated, as shown as step 502. The solution may then be allowed to channel through any existing fractures, as shown at step 504. As the solution moves through the existing fractures and channels, it may serve to clean the well bore and fracture faces, transport coal fines away from the well bore intake, and further etch or enhance any fluid flow channels for improved coal seam permeability, as shown at step 506. If desired, as shown in step 508, the well bore and coal seam may then be overflushed, as described above, to move any coal fines generated by the oxidizing agent solution away from the well bore intake, thus increasing CBM recovery efficiency.

Referring still to the method of FIG. 5, prior to any fracturing or etching processes, the existing well bore may be treated with an acidizing process which may function as a cleansing agent. In particular, an acid may be pumped into the existing well bore to clean the well bore and existing fracture faces by dissolving any precipitates or contaminants due to drilling or completion fluids or cement that may be present at or adjacent the well bore and fracture faces. In one embodiment, an appropriate acid may include an aqueous solution of about 15% by weight hydrochloric acid (HCl). As can be appreciated, however, alternative embodiments may employ acid solutions encompassing comparable pH levels and concentrations without departing from the scope of the present disclosure.

In another exemplary embodiment of the present disclosure, an oxidizing agent solution may be applied at a pressure sufficient to create new fractures or extend existing fractures in a coal seam that has previously been treated and/or stimulated using other methods, but may produce additional CBM if now stimulated by an oxidizing agent. An exemplary oxidizing agent solution that may be used may include the aqueous chemical bases and their equivalents as described above in previous embodiments.

In an exemplary embodiment of operation, the oxidizing agent may be pumped into the previously-stimulated well bore at a rate and pressure sufficient to cause the adjacent formation to extend its existing fractures or create new fractures therein. Besides extending and forming new fractures, the oxidizing agent may serve several functions: It may serve as a cleansing agent by dissolving precipitates or contaminants which may be present at or adjacent the well bore or fracture faces due to drilling or completion fluids or cement; it may dissolve any existing coal fines or transport them away from the well bore intake and into the coal seam fractures; and it may further etch or enhance any existing fluid flow channels in the fracture faces for improved coal seam permeability. Once the fractures have been extended and etched by the oxidizing agent solution to form channels therein, the pressure exerted on the formation may be lowered so that the fractures close, leaving several channels capable of fluid flow.

Figure 6:
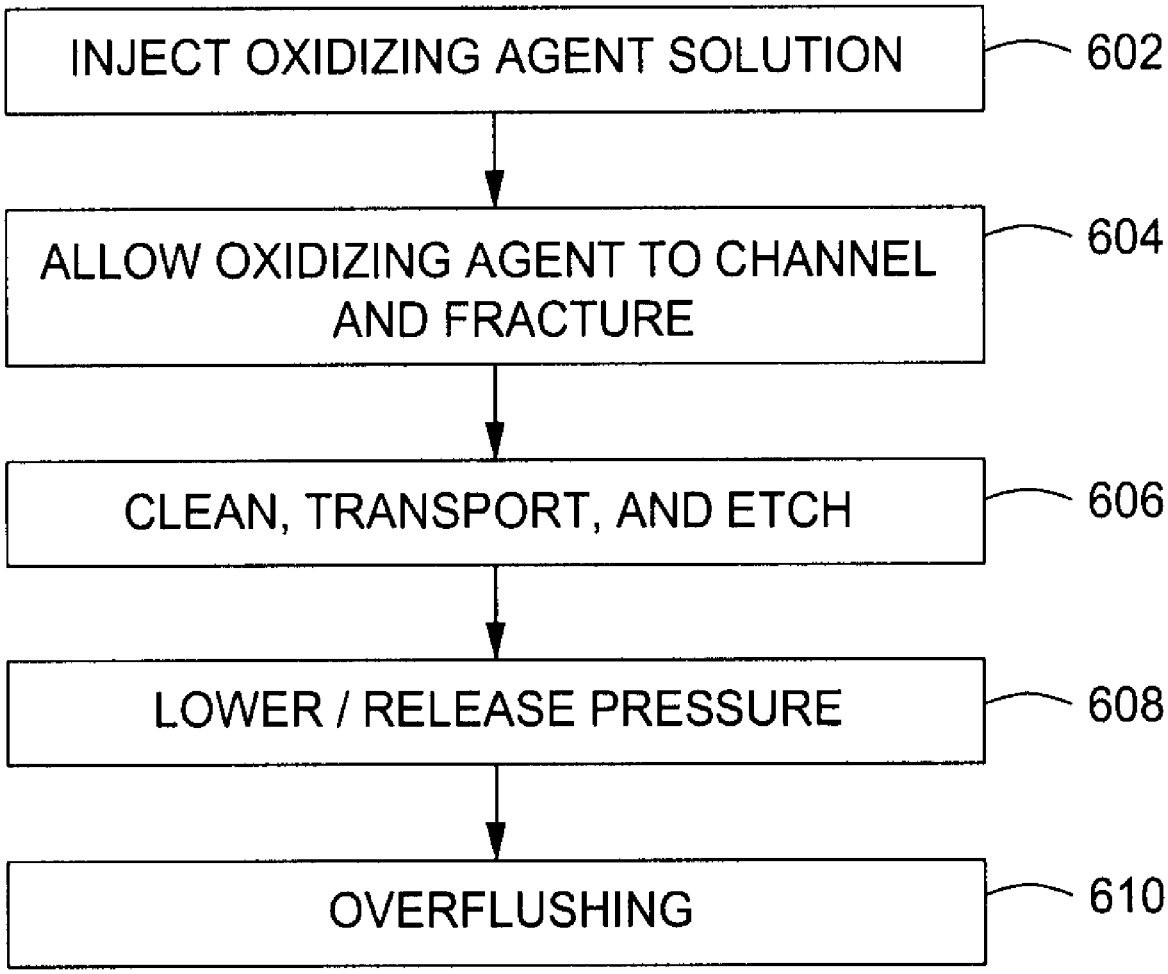
FIG. 6 is a schematic flowchart of a method according to one or more aspects of the present disclosure.

Referring to FIG. 6, illustrated is the above-mentioned method of stimulating a previously-stimulated coal seam. At a rate and pressure sufficient to extend existing fractures or create new fractures therein, an oxidizing agent solution may be injected into an existing well bore and adjacent coal seam that were previously stimulated, as shown as step 602. The solution may then be allowed to channel through the existing fractures and create new fractures, as shown at step 604. As the solution makes its way through the channels, it may serve to clean the well bore and fracture faces, transport coal fines away from the well bore intake, and further etch or enhance any fluid flow channels for improved coal seam permeability, as shown at step 606. Once at least one fracture has been created, extended, or etched by the oxidizing agent, the pressure exerted on the formation may be reduced 608, resulting in the closure of the at least one fracture, yet leaving several channels capable of fluid flow. If desired, as shown in step 610, the well bore and coal seam may then be overflushed, as described in previous embodiments, to move any coal fines generated by the oxidizing agent solution away from the well bore intake, thus increasing CBM recovery efficiency.

Referring still to the method of FIG. 6, prior to any fracturing or etching processes, the existing well bore may be treated with an acidizing process which may function as a cleansing agent. In particular, an acid may be pumped into the existing well bore to clean the well bore and existing fracture faces by dissolving any precipitates or contaminants due to drilling or completion fluids or cement that may be present at or adjacent the well bore and fracture faces. In one embodiment, an appropriate acid may include an aqueous solution of about 15% by weight hydrochloric acid (HCl). As can be appreciated, however, alternative embodiments may employ acid solutions encompassing comparable pH levels and concentrations without departing from the scope of the present disclosure.

In support of the disclosed embodiments, Applicants have reached and applied several conclusions regarding the effects of oxidizing agents on coal. Such conclusions are detailed extensively in the Ph.D. dissertation in petroleum engineering entitled "Optimizing Coalbed Methane Production in the Illinois Basin," authored by Marshall Charles Watson, B.S., M.S. and submitted to the Graduate Faculty of Texas Tech University in May 2008. The dissertation is hereby incorporated by reference in its entirety to the extent that it is not inconsistent with the present disclosure. By way of explanation, and without being bound by any theory, a few of the conclusions reached in the incorporated dissertation are as follows:

Coal desulfurization tests have shown that the oxidization of coal using sodium hypochlorite resulted in overall weight loss. Oxidization yields several products depending on the pH of the base solution and the rank or type of coal. Products vary from black, high molecular weight bicarbonate soluble acids to the benzene poly-carboxylic acids and carbon dioxide. It has been shown that the greater the pH level of the base, the more coal is actually oxidized or dissolved. On the other hand, at lower pH levels (e.g., 9.0-11.0), production of soluble acids was lower whereas the production of $CO_2$ was higher. In one experiment, an 80 percent loss of original carbon was explained as follows: 13.6 percent insoluble residue, 54.9 percent colored acid soluble in an aqueous bicarbonate, 7.1 percent light colored acid soluble in water, and 19.9 percent in $CO_2$.

For the purposes of leaching coal, it was found that single-step leaching with sodium hypochlorite resulted in excessive weight losses. Initial tests were carried out with a 0.4 Molar sodium hypochlorite concentration at room temperature. In one test, a gas evolved from the reaction and the resultant bubbles were believed to be $CO_2$ on top of the leached solution. The test involved a 20 g coal sample leached in 100 ml of 0.4 Molar sodium hypochlorite solution. The sodium hypochlorite had an initial pH level of 11.41 and was at room temperature. Soon after adding the coal into the hypochlorite solution, the temperature increased continuously to 39° Celsius in 30 minutes.

Alternative methods and tests were subsequently used to optimize the leaching of sulfur-functional groups. As a result of the leaching processes, the temperature of the leached slurry was observed to increase above room temperature indicating that the coal was undergoing disassociation by oxidization.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

We claim:

1. A method of fracturing a subsurface coal formation penetrated by a well, comprising:

pumping a fracturing fluid containing propping agents into the subsurface coal formation adjacent the well in a multiplicity of stages at a pressure sufficient to initiate the propagation of at least one fracture within the coal formation;

allowing the at least one fracture to close thereby trapping the propping agents in the at least one fracture to prevent the at least one fracture from fully closing;

alternatingly pumping an oxidizing agent solution into the subsurface coal formation following each of the multiplicity of stages, whereby the oxidizing agent solution etches channels into fracture faces; and overflushing the subsurface coal formation with a fluid configured to transport accumulated coal fines deeper into the subsurface coal formation for improved methane extraction.

2. The method of claim 1, wherein pumping a fracturing fluid containing propping agents into the subsurface coal formation is preceded by treating the well and the subsurface coal formation with an acid to clean the well and the subsurface coal formation by dissolving any precipitates or contaminants due to drilling or completion fluids or cement present at or adjacent the well.

3. The method of claim 2, wherein the acid comprises an aqueous solution of about 15% by weight hydrochloric acid.

4. The method of claim 1, wherein the propping agents comprise spherically shaped sand particles.

5. The method of claim 1, wherein the propping agents comprise a particle size distribution between about 60 and about 140 mesh.

6. The method of claim 1, wherein the oxidizing agent solution is an aqueous base solution containing about 0.4M sodium hypochlorite.

7. The method of claim 1, wherein the oxidizing agent solution comprises an aqueous base solution with a pH level of between about 9.0 and about 13.0.

8. A method of fracturing a subsurface coal formation penetrated by a well, comprising:

pumping a fracturing fluid into the subsurface coal formation to induce at least one fracture thereby exposing at least one fracture face;

pumping an oxidizing agent solution into the subsurface coal formation while maintaining the at least one fracture in an open position to etch channels into the at least one fracture face;

allowing the at least one fracture to close so that the channels remain for fluid flow; and overflushing the subsurface coal formation with a fluid configured to transport accumulated coal fines deeper into the subsurface coal formation for improved methane extraction.

9. The method of claim 8, further comprising injecting additional oxidizing agent solution at a pressure less than a pressure sufficient to create and open the at least one fracture such that the at least one fracture remains closed, whereby additional oxidizing agent solution is pumped through channels to enlarge the channels and increase the fluid flow capacity of the channels.

10. The method of claim 9, wherein the acid comprises an aqueous solution of about 15% by weight hydrochloric acid.

11. The method of claim 8, wherein pumping a fracturing fluid into the subsurface coal formation is preceded by treating the well and the subsurface coal formation with an acid to clean the well and the subsurface coal formation by dissolving any precipitates or contaminants due to drilling or completion fluids or cement present at or adjacent the well.

12. The method of claim 8, wherein the oxidizing agent solution is an aqueous base solution containing about 0.4M sodium hypochlorite.

13. The method of claim 8, wherein the oxidizing agent solution comprises an aqueous base solution with a pH level of between about 9.0 and about 13.0.

14. A method of fracturing a subsurface coal formation penetrated by a well, comprising:

injecting an oxidizing agent solution into the subsurface coal formation to cause a pressure on the subsurface coal formation sufficient to create and open at least one fracture, thereby exposing at least one fracture face;

allowing the oxidizing agent solution to etch the at least one fracture face, thereby forming channels thereon;

reducing the pressure on the subsurface coal formation so that the fractures close but the channels remain for fluid flow; and overflushing the subsurface coal formation with a fluid configured to transport accumulated coal fines deeper into the subsurface coal formation for improved methane extraction.

15. The method of claim 14, further comprising injecting additional oxidizing agent solution at a pressure less than the pressure sufficient to create and open the at least one fracture such that the at least one fracture remains closed, whereby additional oxidizing agent solution is pumped through and enlarges the fluid flow capacity of the channels.

16. The method of claim 14, wherein injecting an oxidizing agent solution into the subsurface coal formation is preceded by treating the well and the subsurface coal formation with an acid to clean the well and the subsurface coal formation by dissolving any precipitates or contaminants due to drilling or completion fluids or cement present at or adjacent the well.

17. The method of claim 16, wherein the acid comprises an aqueous solution of about 15% by weight hydrochloric acid.

18. The method of claim 14, wherein the oxidizing agent solution is an aqueous base solution containing about 0.4M sodium hypochlorite.

19. The method of claim 14, wherein the oxidizing agent solution comprises an aqueous base solution with a pH level of between about 9.0 and about 13.0.

20. A method of fracturing a subsurface coal formation penetrated by a well, comprising:

injecting an oxidizing agent solution containing propping agents into the subsurface coal formation at a rate and pressure sufficient to cause the formation of at least one fracture, thereby exposing at least one fracture face;

allowing the oxidizing agent solution to etch the at least one fracture face, thereby forming channels thereon;

reducing the pressure in the subsurface coal formation and allowing the at least one fracture to close, thereby trapping the propping agents in the at least one fracture to prevent the at least one fracture from fully closing; and overflushing the subsurface coal formation with a fluid configured to transport accumulated coal fines deeper into the subsurface coal formation for improved methane extraction.

21. The method of claim 20, further comprising injecting additional oxidizing agent solution at a pressure less than the pressure sufficient to create and open the at least one fracture such that the at least one fracture remains closed, whereby additional oxidizing agent solution is pumped through and enlarges the fluid flow capacity of the channels.

22. The method of claim 20, wherein injecting an oxidizing agent containing propping agents into the subsurface coal formation is preceded by treating the well and the subsurface coal formation with an acid to clean the well and the subsurface coal formation by dissolving any precipitates or contaminants due to drilling or completion fluids or cement present at or adjacent the well.

23. The method of claim 22, wherein the acid comprises an aqueous solution of about 15% by weight hydrochloric acid.

24. The method of claim 20, wherein the oxidizing agent solution comprises an aqueous base solution containing about 0.4M sodium hypochlorite.

25. The method of claim 20, wherein the oxidizing agent solution comprises an aqueous base solution with a pH level of between about 9.0 and about 13.0.

26. A method of stimulating a subsurface coal seam penetrated by a well bore having a well bore intake, wherein the subsurface coal seam was previously stimulated, comprising:

injecting an oxidizing agent solution into the well and subsurface coal seam at a pressure below the fracture pressure of the subsurface coal seam, wherein the subsurface coal seam has at least one existing fracture;

allowing the oxidizing agent solution to channel through the at least one existing fracture, to clean the well and the at least one existing fracture, to transport coal fines away from the well bore intake, or to etch at least one fluid flow channel on the at least one existing fracture or enhance any existing fluid flow channels on the at least one existing fracture; and overflushing the subsurface coal formation with a fluid configured to transport accumulated coal fines deeper into the subsurface coal formation for improved methane extraction.

27. The method of claim 26, wherein injecting an oxidizing agent solution into the well bore and subsurface coal seam is preceded by treating the well bore and the subsurface coal seam with an acid to clean the well and the subsurface coal seam by dissolving any precipitates or contaminants due to drilling or completion fluids or cement present at or adjacent the well bore.

28. The method of claim 27, wherein the acid comprises an aqueous solution of about 15% by weight hydrochloric acid.

29. The method of claim 26, wherein the oxidizing agent solution comprises an aqueous base solution containing about 0.4M sodium hypochlorite.

30. The method of claim 26, wherein the oxidizing agent solution comprises an aqueous base solution with a pH level of between about 9.0 and about 13.0.

31. A method of stimulating a subsurface coal seam penetrated by a well bore having a well bore intake, wherein the subsurface coal seam was previously stimulated, comprising:

injecting an oxidizing agent solution into the well and subsurface coal seam to cause a pressure on the subsurface coal formation sufficient to create and open at least one fracture;

allowing the oxidizing agent solution to channel through the at least one existing fracture, to clean the well and the at least one existing fracture, to transport coal fines away from the well bore intake, or to etch at least one fluid flow channel on the at least one existing fracture or enhance any existing fluid flow channels on the at least one existing fracture;

reducing the pressure on the subsurface coal formation so that the at least one fracture closes but the fluid flow channels remain for fluid flow; and overflushing the subsurface coal formation with a fluid configured to transport accumulated coal fines deeper into the subsurface coal formation for improved methane extraction.

32. The method of claim 31, wherein injecting an oxidizing agent solution into the well bore and subsurface coat seam is preceded by treating the well bore and the subsurface coal seam with an acid to clean the well and the subsurface coal seam by dissolving any precipitates or contaminants due to drilling or completion fluids or cement present at or adjacent the well bore.

33. The method of claim 32, wherein the acid comprises an aqueous solution of about 15% by weight hydrochloric acid.

34. The method of claim 31, wherein the oxidizing agent solution comprises an aqueous base solution containing about 0.4M sodium hypochlorite.

35. The method of claim 31, wherein the oxidizing agent solution comprises an aqueous base solution with a pH level of between about 9.0 and about 13.0.

* * * * *